US009984597B2

(12) United States Patent
Galoff et al.

(10) Patent No.: US 9,984,597 B2
(45) **Date of Patent: *May 29, 2018**

(54) TEMPORARILY REMOVABLE REVERSE-PRINTED LABEL ASSEMBLY

(71) Applicant: Outlook Group, LLC, Neenah, WI (US)

(72) Inventors: Tina Marie Galoff, Brillion, WI (US); Pat Harvath, Neenah, WI (US); Todd Schuh, Combined Locks, WI (US)

(73) Assignee: Outlook Group, LLC, Neenah, WI (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/402,766

(22) Filed: Jan. 10, 2017

(65) Prior Publication Data

US 2017/0132956 A1 May 11, 2017

Related U.S. Application Data

(63) Continuation-in-part of application No. 14/206,031, filed on Mar. 12, 2014, now Pat. No. 9,548,006.

(60) Provisional application No. 61/779,267, filed on Mar. 13, 2013.

(51) Int. Cl.
*G09F 3/10* (2006.01)
*G09F 3/02* (2006.01)

(52) U.S. Cl.
CPC ..... *G09F 3/10* (2013.01); *G09F 3/02* (2013.01); *G09F 2003/0222* (2013.01); *G09F 2003/0257* (2013.01)

(58) Field of Classification Search
None
See application file for complete search history.

(56) References Cited

U.S. PATENT DOCUMENTS 5,766,401 A * 6/1998 Campbell ..... B32B 38/14 156/252
6,332,631 B1 * 12/2001 Kirk ..... G09F 3/02 283/101
2002/0036228 A1 * 3/2002 Reese ..... B65D 3/22 229/4.5

(Continued)

*Primary Examiner* — Kristina N Junge
(74) *Attorney, Agent, or Firm* — Duane Morris LLP

(57) ABSTRACT

The present invention relates to an adhesive-backed printed pressure sensitive cut label assembly with easy temporary removability, wherein the portion of the label forming the label stock may be printed on the back- or reverse-side of the label face stock and whereby the printed surface is applied with a hot melt or acrylic adhesive that ensures easy short-term removability from a container surface and reapplication thereto. The label stock is laminated to a base stock comprising a paper or polymeric release liner coated with silicone or other adhesive release coating. During manufacturing of the label assembly, the label stock and base stock are simultaneously fed to laminating rollers following a die-cutting process, whereby the two are joined. One feature of the invention is the ease of temporary removability after application to the surface of a container whereby there is no adhesion of the ink printed on the label to the container surface itself. An additional feature is the elimination of the need for an overlamination of the label face stock when using a reverse-printed label face stock over which an appropriate adhesive is applied.

20 Claims, 2 Drawing Sheets

(56) References Cited

U.S. PATENT DOCUMENTS

2007/0252380 A1* 11/2007 Crum ..... G09F 3/02
283/101
2014/0008441 A1* 1/2014 Huynh ..... G09F 3/0294
235/468
2014/0242316 A1* 8/2014 Shih ..... B32B 27/08
428/41.3

* cited by examiner

TEMPORARILY REMOVABLE REVERSE-PRINTED LABEL ASSEMBLY

CROSS REFERENCE TO RELATED APPLICATIONS

This application is a continuation-in-part of U.S. application Ser. No. 14/206,031, which claims priority to U.S. provisional application Ser. No. 61/779,267 which was filed in the United States Patent and Trademark Office on Mar. 13, 2013.

BACKGROUND OF THE INVENTION

U.S. Pat. No. 6,852,191 discloses a method and apparatus for making an adhesive-backed label whereby glassine paper stock is unwound from a roll, coated with photo-cationic silicone and cured using ultraviolet light to form a silicone coated release paper. The means of applying silicone comprises a closed chambered doctor blade. Adhesive is applied over the cured silicone layer of the coated glassine paper, cooled using a first cooling roller, then fed with a face stock to a laminator and cooled with a second cooling roller.

U.S. Pat. No. 7,608,161 discloses a method and apparatus for making adhesive-backed labels whereby glassine paper stock is unwound from a roll and coated with photo-cationic silicone and exposed to a wavelength-controlled illumination to cure. Hot melt adhesive is applied over the silicone. Simultaneously, label stock is fed with the coated glassine paper to laminating rollers where the two are joined, and the label stock is cooled using a first cooling roller and then a second cooling roller downstream. Illumination to cure the silicone is provided by a dichroic reflector.

US 2005/0089662 discloses a method and apparatus for making adhesive-backed labels whereby glassine coated paper is coated with silicone, the silicone is cured, and a hot melt adhesive is applied over the silicone layer. The glassine coated paper is then laminated to a label face stock.

U.S. Pat. No. 7,556,708 discloses a method and apparatus that forms a cut label on a liner by feeding a web of lined label material to a cutting station (either a laser cutter or anvil roller and hammer die head cutter) to cut the label material, forming a matrix around the cut label and stabilizing the label edge without vacuum, stripping the cut label from the label material and applying labels to a substrate.

U.S. Pat. No. 7,815,761 discloses a method for forming a cut label on a liner by feeding a web of unlined label material having an adhesive face to a cutting station comprised of a chilled rotating die head with multiple raised cutting edges, cutting the label material to provide a matrix around the label and stabilizing the label material with respect to the matrix without vacuum and feeding a web of liner to a set of rollers against the adhesive face of the label material.

US 2011/0036504 discloses a chilled rotating die head for cutting or perforating pressure-sensitive labels.

U.S. Pat. No. 8,163,365 (the "'365 patent") teaches a method of forming a sheet of label material for placement on a paper object, such as a newspaper, and then subsequent removal of the label from the paper object without damaging the object. The method includes coating a water-based, pressure-sensitive adhesive on the face of a paper substrate using a gravure coater to form a repetitive dot pattern of adhesive areas. The repetitive dots assure a uniform, discontinuous coating of adhesive that allows repositioning of the label and prevents tearing of or damage to the paper surface when the label is removed, and that maintains sufficient adhesion to adhere to difficult substrates such as textured surfaces. A further embodiment of the '365 patent includes adhesive coating a release liner with the repetitive dotted pattern, providing removability of the paper label from the liner. The labels are surface printed with ink on the surface of the label opposite to which the adhesive is applied. The printed surface is further coated with a protective laminate release coating and then label shapes are die cut. The present invention improves upon the '365 patent by enabling a removable, repositionable pressure-sensitive label that can be adhered to several surfaces, including glass and plastic containers.

U.S. Pat. No. 8,076,004 (the "'004 patent") teaches a flexible substrate, such as a paper or nonwoven substrate used for gift wrap or envelope, that is coated with a release material to enable the temporary repositioning of an adhesive applied over or on the release material. Over time, the adhesion between the release material and the applied adhesive builds so that the adhesive cannot be removed from the release material without damaging the underlying sheet material. The release material is dispersed on the flexible substrate and allows for repositioning when contacted with a pressure sensitive adhesive for at least 1 minute and not more than 10 minutes. In applications such as gift wrapping or sealing envelopes, an indefinite ability to remove the adhesive from the sheet material is not desired. Accordingly, the '004 patent permits the adhesive to bond after a short period to prevent exposing the contents of the wrapped package or envelope. The release material is selected from the group consisting of polysiloxane-acrylic block or graft polymers or polysiloxane-urea copolymers.

It is generally known in the art that printed labels with a pressure-sensitive adhesive backing are applied to plastic or glass containers for food products, health and beauty products, liquids, soaps, vitamins and other similar end-use products, among many others. The labels are made so as to require the removal of a liner, generally known as a "release liner." A "release liner" may be made from coated or uncoated papers or polymeric films, and is typically coated with a silicone layer that enables the liner to release from the label before it is applied to a container. Removal of the release liner exposes the pressure-sensitive adhesive, permitting the label to adhere and be applied to the container with the application of slight pressure to create a strong adhesive bond between the label and container. Once applied, the conventional pressure sensitive label is not meant to be easily removed but is strongly adhered to the container surface.

The term "pressure-sensitive adhesive," as used herein, refers to an adhesive which adheres to a surface as a result of slight application of pressure, through any known means, as opposed to thermal activation, evaporation, or absorption of a solvent to form a solid bond.

Pressure-sensitive labels can be provided in many different formats, with the most significant being a format of label face stock made from a natural or synthetic fiber paper, polymeric film, metal foil or combinations of these materials, a pressure-sensitive adhesive, and a release liner in contact with the adhesive. These three components—label face stock, pressure-sensitive adhesive and release liner—are referred to herein as "label stock material." Labels are made using label stock material and cutting the label face stock by cutting or micro-perforating the shape of the label, by known means, e.g., a laser cutter, an anvil roller and die head cutter or other cutting method, into the label stock material, leaving a remainder portion of the label material around the cut label shape known as the matrix. The matrix is removed, leaving the labels attached to the release liner and rolled in multiple label widths into a web, then moved to a separate operation and slit into single label width webs.

The most typical format of a pressure-sensitive label comprises a laminated combination of a printed face stock that is printed on the top surface (opposite the surface to which adhesive is applied) and covered with an over-print varnish or with a laminated film layer to prevent ink rub-off; a pressure-sensitive adhesive on the back or reverse side of the face stock; and a silicone layer and backing paper liner to which the silicone layer is relatively strongly adhered. The face stock can be transparent or opaque. Opaque face stock (typically a paper face stock) can be pre-printed on the top and back sides, for instance, when a label is applied to a transparent container such as a plastic or glass bottle and is filled with a relatively transparent liquid, such as detergent or soap. The printing on the back- or reverse-side of the label face stock can then be read through the container and the product contained therein. Transparent film face stock usually is printed only on the front- or surface-side of the label, with the ink covered by a layer of protective varnish or an additional layer of transparent film. The present invention, which allows reverse-printing of the label face stock, obviates the need for overlamination of the front label surface using a varnish or additional layer of transparent film.

The conventional adhesive used in a pressure-sensitive label is water-based, requiring a relatively long air drying time. The release liner most typically used is a glassine paper coated with silicone to produce a suitable release effect between the label face stock and the release liner when the label is applied to a container or other surface. The prior art method of manufacturing such pressure-sensitive labels with silicone-coated release liner involves numerous steps and has many drawbacks. First, the roll of glassine paper has to be hung and unwound to apply silicone. The curing process involves relatively large equipment with controlled humidity and temperatures. Second, the cured release paper is then rewound and hung on a second lamination machine where adhesive is applied to the paper, laminated at another station to a printable face stock and hung in a lengthy 200-foot air drying structure to adequately cure. Following this manufacturing process, a printer unwinds the roll of label stock material to print the label face stock.

This label manufacturing process is cumbersome, involves multiple steps, large equipment, and numerous lamination steps followed by a final printing step. Moreover, this prior art makes it impossible to print on the back or reverse side of the label face stock to which the adhesive is strongly bonded. In the event of a label stock material that is desired to be printed on the back side of the label face stock, the prior art makes it necessary to strip the label face stock from the liner, print on the backside of the label face stock, and then re-laminate the face stock to the liner. The prior art in such reverse-side label printing is cumbersome and involves multiple re-lamination, printing, and de-lamination steps. Further, the prior art results in a label that makes rework or short-term removability following label application difficult to nearly impossible because of the adherence of ink to the adhesive and the container surface to which the label was initially applied. Moreover, when reverse-side printing is desired, the label face stock must be de-laminated from the release liner and printing is typically done over the adhesive. The result is blurry printing and limited graphics in order to avoid deadening of the adhesive.

U.S. Pat. No. 6,852,191 (the '191 patent) and U.S. Pat. No. 7,608,161 (the '161 patent) (collectively the "Bayzelon Patents") attempt to improve upon the prior art manufacturing process by eliminating the need for multiple lamination passes, long silicone and adhesive curing times, and the associated unwinding and rewinding processes. The Bayzelon Patents disclose a method of manufacturing pressure-sensitive adhesive label stocks with back-side printing whereby glassine paper release stock is unwound from a roll, coated with a fast-curing, photo-cationic silicone, and exposed to wavelength-controlled ultra-violet illumination to cure. Illumination is provided by a dichroic reflector. A hot melt adhesive is applied over the silicone layer on the release paper and cooled using a cooling roller. Simultaneously, label stock is fed with the coated glassine paper to laminating rollers where the two are joined and the label stock material is further cooled using a second downstream cooling roller. An advantage of the Bayzelon Patents is that the label face stock can be reverse printed on the back side before the label face stock and release paper are laminated, eliminating the need for a subsequent de-lamination and re-lamination of the label face stock from and to the liner downstream in the overall process. Because printing is not done over the adhesive, the Bayzelon Patents eliminate the likelihood of blurred printing on the reverse side of the label face stock. Further, the Bayzelon Patents obviate the need for lengthy equipment to cure the silicone release liner and provide an apparatus that essentially produces a web of labels in multiple label widths married to a release liner in a single pass.

U.S. Pat. No. 7,556,708 (the '708 patent) discloses a method of forming a cut label on a liner by feeding completed label stock material (a label face stock laminated to a release liner) into a station that de-laminates the face stock from the release liner, cuts label material, and then re-laminates the label face stock to the release liner, forming a web of multiple widths of cut labels. The '708 patent process also enables the manufacturing of liner-less labels to be used in liner-less label application equipment by re-laminating the label face stock to a temporary, or carrier, liner that is easily removed by such application equipment. This de-lamination and relamination process is cumbersome, time-consuming and inefficient with respect to the process used to manufacture the present invention. Further the '708 patent does not teach a method enabling reverse printing on the back side of the label face stock.

U.S. Pat. No. 7,815,761 (the '761 patent) teaches a method of creating liner-less labels by using a temporary, or carrier liner, or labels with thin liners. The '761 patent eliminates the de-lamination and re-lamination steps in the label cutting process of the '708 patent by disclosing a cutting method that involves a rotating chilled die cutting head to cut the completed label stock material (face stock laminated to release liner) to provide a matrix around the label shape. The '761 patent process uses a chilled die cutting roller that is chilled to a temperature at or below the glass transition temperature (Tg) of the adhesive (which reduces or eliminates the tackiness of the adhesive) that adheres the label face stock to the liner. The chilled die cutting method cuts through the label face stock easily without slicing through to the liner. The '761 patent also discloses the preferred embodiment of the die cutting of liner-less labels with an exposed adhesive surface by use of the chilled die cutting roller chilled to the Tg of the adhesive. The liner-less labels are laminated to a temporary, or carrier or sacrificial liner so that they can be used in conventional label application equipment. The '761 patent also teaches a method where a carrier or sacrificial liner is used prior to die cutting, a vacuum is used to remove or de-laminate the carrier or sacrificial liner, and then the face stock is laminated to a final liner after die cutting, enabling the use of thinner liners. Temporary, sacrificial or carrier liners may be re-used a limited number of times. After cutting the label shapes in accordance with the '761 patent process, the label is stabilized with respect to the matrix without the use of vacuum. The avoidance of vacuum securement is advantageous with the use of thinner liners which may be more readily deformed than would thicker, heavier release liners. US 2011/0036504 describes an improved cooled die head over that taught in the '761 patent for cutting or perforating label materials.

Like the '708 patent, the '761 patent does not teach a method that enables reverse printing of the label face stock. The present invention is a reverse-printed pressure sensitive label assembly that is manufactured in a way so as to ensure easy short-term removability once a label is applied to the surface of a container for purposes of rework or repositioning. The unique feature of the present invention is that upon short-term removal and repositioning of the label face stock on a container, no ink adheres to the surface of the container as is typical of other prior art labels.

SUMMARY OF THE INVENTION

The present invention improves upon the prior art by providing a reverse-printed pressure-sensitive cut label assembly using thin or lighter liners. The label assembly is manufactured in a continuous process and single pass. The invention eliminates the need for printing over the adhesive or silicone and permits reverse printing directly on the backside of the label face stock. Further, the invention obviates the need for overlamination of the front surface of the label face stock, eliminates the need for shipment of finished label material to a printer for printing, and eliminates the multiple steps and costly equipment involved in silicone coating release paper in-line during the label making process. In addition, the present invention improves upon the prior art by providing multiple, single webs of cut reverse-printed labels in a single pass, saving both materials costs and additional unwinding, slitting and rewinding steps and equipment. The present invention also improves upon the prior art by eliminating the de-lamination and re-lamination steps of the manufacturing process and disruption of the label-making process by use of a temporary, carrier or sacrificial liner as taught in the '761 patent. A unique feature of the present invention enables the reverse-printing of transparent film or opaque label face stock and marriage of the face stock with a light-weight polymeric film or paper release liner coated with an adhesive release coating or silicone. Another unique feature of the invention is the consistent coat weight of adhesive applied to the back of the label face stock, trapping the ink and ensuring ink adhesion to the back of the label face stock during the removability and repositioning of labels as necessary in the label application process. It is novel to the present invention to pre-print or, in one embodiment, to print in-line, on the reverse-side of a thin polymeric film or opaque label polymeric film, foil or paper, cellulose-based films, corn or renewable resource or feedstock based films, or cellophane (or combinations thereof) face stock, apply adhesive to the reverse side of the label face stock over the ink (eliminating the need for any UV or over-print varnish of surface-printed labels), laminate the label face stock to an adhesive-release coated polymeric film or paper liner, cut a web of multiple label widths to provide a removable matrix, remove the matrix in a continuous process, and slit the web of multiple label widths into single rolls of finished label materials. It is further unique to this invention to pre-print white ink on the reverse-side of a thin polymeric film label face stock to create an opaque, reverse-printed label to replicate a white film or a paper label stock that obviates the need for overlamination using a varnish or other clear film layer on face stocks that are surface-printed. The opaque surface enables the printing of improved, full cover graphics on the back of the label over the white ink. An advantage of the invention as opposed to paper labels or other reverse printed labels of the prior art is the assurance of ink adhesion to the back of the label face stock in the event of short-term repositioning once the label is adhered to a container surface. The present invention also improves upon the prior art wherein the label face stock is printed over the adhesive surface, which is uneven and limits the quality, type and amount of graphics that can be printed on the back of a label. The invention enables full cover graphics that can easily be read on the back of a label face and eliminates a secondary material, such as a UV varnish or film, to prevent ink pick-off from the typical surface-printed label face stock. The present invention is further superior to conventional labels printed on the adhesive surface applied to the label face stock, because printing over adhesive limits the amount of graphics that can be printed to avoid deadening of the adhesive, since too much ink would eliminate the adhesive characteristics of the label.

A unique clement for the practice of the present invention comprises a means for reducing the amount of work that has to be performed in a single line and a means for eliminating the separating of work onto different lines and even different locations, which reduces waste and cross-contamination of materials. The single-pass operation of the present invention enables line speeds of up to 500 feet per minute (fpm) to produce single label-width webs of reverse-printed cut pressure-sensitive labels to be shipped directly to businesses involved in label application. An additional feature of this invention is the real-time monitoring of adhesive as it is applied so as to maintain a minimal waste level of adhesive and a consistent application across the web. The unique aspect of applying a minimal, consistent adhesive coat weight also reduces finished label waste at the applicators' facilities, because of the ease of removability and re-positioning of the labels. Furthermore, by using the present invention, label manufacturers print the face stock and produce the laminated label stock material rather than buying a more costly prefabricated laminated product and subsequently printing on the face stock. An additional benefit from the present invention is achieved when a clear label face stock is reverse printed prior to lamination to the release liner, because the print is then protected from pick-off by the polymeric film face stock after applied to a transparent container through which the label may be read. When the label is applied to a container, the print on the back-side of the label face stock is protected by the film label face itself, eliminating the use of an additional UV varnish, UV glued film or pressure-sensitive film typical of the prior art surface-printed label stock.

Cost savings to label makers are further generated by a reduction of waste due to the fact that only the label face stock is printed. Additional savings occur when the printing occurs, as with one embodiment of the invention in-line as part of the label-making process itself. Moreover, there are no limitations on the printing methods, which can be flexographic, offset, roto-gravure, digital, letterpress, silk screen, etc.

Further and additional features of the present invention will be described in the following detailed specification which is to be read in conjunction with the accompanying drawings.

DETAILED DESCRIPTION OF THE INVENTION

Figure 1:
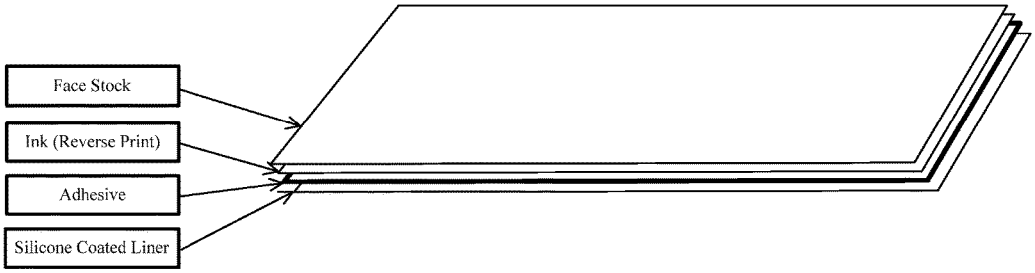
FIG. 1 is a drawing depicting the label stock material with a reverse-printed label face stock.
Figure 2:
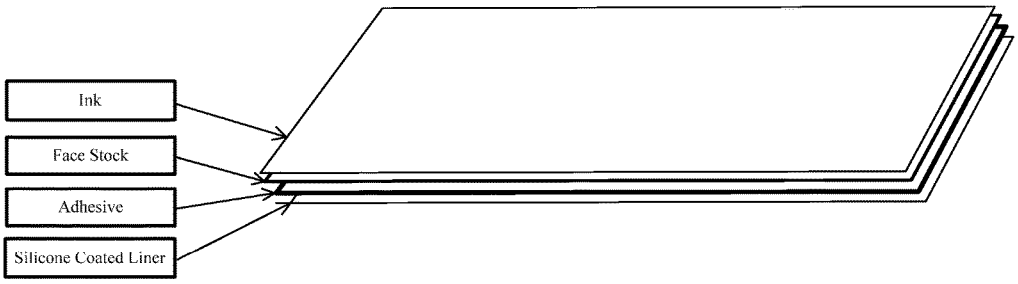
FIG. 2 is a drawing depicting the label stock material with a surface-printed label face stock.

The present invention relates to a reverse-printed, pressure-sensitive cut adhesive label assembly manufactured in a single pass and may include and use any label face stock material, whether on paper bases (both natural fiber paper and synthetic fiber paper or combinations thereof), polymeric film, metal foil, cellulose-based films, corn-based or renewable resource of feedstock based films, polyester (polyethylene terephthalate, or PET), or cellophane, or combinations of these materials. The release liner portion of the invention may include and use any natural or synthetic paper fiber stock or polymeric film, or combinations thereof, pre-coated with a pressure-sensitive silicone or adhesive release coated layer. The label face stock may be printed in-line or on a secondary line and the reverse-printed label stock fed into the process using any known unwind mechanism and then conveyed to the adhesive coating station. The label face stock may be printed on only the reverse side, only the surface side, or on both sides of the label face stock. The printing method can be flexo-graphic, roto-gravure, offset, letterpress, digital, silkscreen, or other means that permit label removability following application to the surface of a container with 100% adhesion of ink to the label when the label is removed from the container surface for the purpose of rework or repositioning. A unique feature of the preferred embodiment of the invention is easy removability of the labels following application to the surface of a container in the event that repositioning or rework is needed with no ink adhering to the container surface or being picked off the label. A further unique feature of the invention is that a polymeric film is reverse-printed with full cover white ink to replicate a white film or paper label and full cover graphics may be printed on the reverse surface to provide a reverse-printed label with enhanced appearance and no need for an over-print varnish, UV glue or adhesive, or film to protect ink rub-off, as needed in conventional surface-printed labels. The present method also enables easy removability of a label after application to a container surface with full ink adhesion to the label face stock and no ink pick-off or rub off onto the container surface.

U.S. Pat. No. 6,852,191 and U.S. Pat. No. 7,608,191 (the "Bayzelon Patents") disclose a method of producing reverse-printed, pressure sensitive cut labels. Unlike the present invention, the Bayzelon Patents contemplate the use of pre-printed label face stock and teach a method of silicone coating the release liner in-line, curing the silicone, and then applying a layer of hot melt adhesive over the cured silicone layer on the release liner. In contrast, the present invention relates to a label that is printed directly on the reverse side of the label face stock and adhesive is applied over the print using inks that enable 100% adhesion to the label if removed for rework or relocation during or following the application of the label to a container surface. Further, because practice of the present invention uses pre-siliconized release liner, the invention improves upon the Bayzelon Patents by allowing for increased efficiencies due to the complicated silicone coating process and curing time and related costly equipment such as a UV curing system. Moreover, the present invention allows for less waste in manufacturing due to the use of presiliconized release liner and further enhanced efficiencies when using pre-printed label face stock or, as in one embodiment printing in-line in a single pass as part of the label making process. Finally, the Bayzelon Patents disclose a method that produces a web of multiple finished label widths, requiring removal of the webs to a separate slitting and rewinding operation. In contrast, the present invention improves the prior art by slitting the web of multiple finished label widths in-line into single finished label width rolls, eliminating the need for secondary slitting and rewinding equipment and enhancing cost efficiencies by producing single finished label width rolls in-line. The present invention lowers the cost of finished labels by eliminating additional slitting and rewinding processes and auxiliary equipment time and operation.

U.S. Pat. No. 7,556,708 (the '708 patent) discloses a method of producing labels from laminated label material by de-laminating the face stock from the release liner, cutting the labels, then re-laminating the face stock and release liner using adhesive. This method is costly and inefficient, involving a cumbersome de-lamination and re-lamination process that results in a potential for significant waste. Furthermore, the cutting mechanism, unlike the present invention, does not teach a method of chilling the die head and is likely to result in gumming up of the cutting edges with adhesive, resulting in significant down-time due to clogged tooling. Moreover, unlike the present invention, the '708 patent does not disclose a method of producing individual webs of finished single label width rolls and requires additional equipment, time and inefficiencies to slit multiple label width webs into individual label webs.

U.S. Pat. No. 7,815,761 (the '761 patent) discloses a method for forming a cut label using a chilled die head and stabilizing the cut labels without vacuum. In contrast to the '761 patent, the present invention is manufactured in a process that stabilizes the cut labels using micro-bridging or micro-perforation around the label edges and can be done with or without vacuum. Furthermore, the '761 patent teaches a method of cutting a liner attached to a carrier or sacrificial liner, then removing the sacrificial or carrier liner after die cutting, and re-laminating the face stock to a permanent liner. Again, the de-lamination and re-lamination process decreases efficiencies and line speeds and creates an increased opportunity for waste. Moreover, the use of a sacrificial or carrier liner requires that the label-making process be shut down so that the sacrificial or carrier liner can be rewound and rehung for use in the die-cutting process. The manufacturing method for the present invention eliminates this cumbersome and waste-producing process by die-cutting the label face stock through the exposed adhesive and immediately laminating the face stock to a pre-siliconized release liner. In addition, neither the '708 nor '761 patents enable reverse-printing of the label face stock as does the present invention, which teaches a method of full cover, enhanced graphics printed directly on the back side of the label face stock in a single-pass label-making process. Moreover, the '761 patent does not teach a method of creating single label-width webs of finished label material; rather, secondary slitting and rewinding operations are required, decreasing efficiencies and increasing costs of production and opportunities for waste. Furthermore, the '761 patent contemplates a module that can be attached to an existing lined label applicator machine; in contrast, the present invention results in single label width webs of finished labels to be shipped directly to label applicators. Finally, the '761 patent describes a method of stabilization of the cut labels with respect to the matrix without the use of vacuum. The present invention can stabilize the cut label using micro-bridging or micro-perforating around the label shapes, and stabilization can be done with or without vacuum.

U.S. Pat. No. 8,163,365 (the "'365 patent") teaches a method of forming a sheet of label material for placement on a paper object, such as a newspaper, and then subsequent removal of the label from the paper object without damaging the object. The method includes coating a water-based, pressure-sensitive adhesive on the face of a paper substrate using a gravure coater to form a repetitive dot pattern of adhesive areas. The repetitive dots assure a uniform, discontinuous coating of adhesive that allows repositioning of the label that prevents tearing of or damage to the paper surface when the label is removed, and that maintains sufficient adhesion to adhere to difficult substrates such as textured surfaces. A further embodiment of the '365 patent includes adhesive coating a release liner with the repetitive dotted pattern providing removability of the paper label from the liner. The labels are surface printed with ink on the surface of the label opposite to which the adhesive is applied. The printed surface is further coated with a protective laminate release coating and then label shapes are die cut. The present invention improves upon the '365 patent by enabling a removable, repositionable pressure-sensitive label that can be adhered to several surfaces, including glass and plastic containers. In contrast to the labels produced by the method of the '365 patent, the present invention teaches a reverse-printed label assembly coated with adhesive over the ink rather than a surface-coated label face, and also includes a label stock that can be printed on one or both sides of the label as well as short-term repositionable label stock material. Moreover, the preset invention teaches a label whereby the adhesive is coated over the entire surface of the printed side of the label, rather than in a dotted pattern, and can be applied by any known coating means. The present invention also may use water-based or solvent-based hot melt pressure sensitive adhesive applied by any known means, rather than only the gravure roll method of the '365 patent. Finally, contrary to one embodiment of the '365 patent, the present invention is made by applying adhesive directly to the label face over the reverse-printed surface rather than a release liner.

U.S. Pat. No. 8,076,004 (the "'004 patent") teaches a flexible substrate, such as a paper or nonwoven substrate used for gift wrap or envelope, that is coated with a release material to enable the temporary repositioning of an adhesive applied over or on the release material. Over time, the adhesion between the release material and the applied adhesive builds so that the adhesive cannot be removed from the release material without damaging the underlying sheet material. The release material is dispersed on the flexible substrate and allows for repositioning when contacted with a pressure sensitive adhesive for at least 1 minute and not more than 10 minutes. In applications such as gift wrapping or sealing envelopes, an indefinite ability to remove the adhesive from the sheet material is not desired. Accordingly, the '004 invention permits the adhesive to bond after a short period to prevent exposing the contents of the wrapped package or envelope. The release material is selected from the group consisting of polysiloxane-acrylic block or graft polymers or polysiloxane-urea copolymers. In contrast to the present invention involving a release liner, adhesive and label face stock, the '004 patent teaches a flexible substrate, such as gift wrap, to which a release material is applied. The '004 patent permits adhesive tape, for instance, to adhere and be temporarily repositioned.

The present invention contemplates a method of pre-printing either the surface or reverse side of the label face stock or printing in-line as part of the label making process, or printing both sides of the label stock on a secondary line or in-line as part of the label making process. Printing can be done by any known means using commercially available UV, Flexographic, UV Flexographic, water-based, solvent or other inks which result in complete adhesion of ink to the label surface (with 0% adhering to the container surface) following removability within a short time period after application of the label to a container surface. The preferred embodiment of the invention results in 100% ink adhesion to the label face stock following a base line of testing within 5 and 60 minutes of application of the label to a clear plastic bottle surface or other surface, including glass.

Testing for ink adhesion can be done by use of a Thwang Albert Model 225-1 unit, which is designed to test and measure label peel strength and convert into several different units of measure utilizing a calibrated load cell and a mechanically repeatable motor/pulley system. Data is retained and recorded on a print out. With respect to the present invention, the speed parameters used for testing ink adhesion using the Thwang Albert Model 225-1 peel-testing unit were 12 inches per minute with a 3 second pre-peel (window of time prior to load cell taking live data). The unit of measure was grams and the total test time was 9 seconds (minus the pre-peel). Each label sample was cut into a 1-inch strip and was 5 inches in length. The sample strips were applied to flat strips cut from a clear polyester (PET) bottle. Samples were tested initially after 5 minutes and again at 60 minutes. Results of the tests were recorded along with a percentage of ink that was visibly observed remaining on the PET test bottle to which the labels were applied. Test data and results are summarized below:

| Ink/Label face stock/Adhesive | Ink Adhesion/ 5 mins | Ink Adhesion/ 60 mins |
|---|---|---|
| Sample 1 Flexo water-based ink Solvent primed BOPP Clear on Clear Adhesive | 0% (1200-1800 gms peel force) | 0% (1000-1600 gms peel force) |
| Sample 1 water based ink Acrylic coated BOPP Clear on Clear Adhesive | 0% (1300-1700 gms peel force) | 0% (1100-1800 gms peel force) |
| Sample 2 UVF ink Solvent Primed BOPP Clear on Clear Adhesive | 0% (900-1200 gms peel force) | 0% (1100-1400 gms peel force) |
| Sample 2 UVF Ink Acrylic Coated BOPP Clear on Clear Adhesive | 0% (850-1200 gms peel force) | 0% (1400-1500 gms peel force) |
| Sample 3 UVF Ink Acrylic coated BOPP Clear on Clear Adhesive | 0% (1400-1800 gms peel force) | 0% (1100-1400 gms peel force) |
| Sample 1 water-based Solvent Primed BOPP Paper Grade Adhesive | 0% (700-1200 gms peel force) | 0% (1100-1300 gms peel force) |
| Sample 1 water-based Acrylic coated BOPP Paper Grade Adhesive | 0% (1100-1300 gms peel force) | 0% (1100-1300 gms peel force) |
| Sample 2 UVF ink Solvent Primed BOPP Paper Grade Adhesive | 0% (1100-1300 gms peel force) | 0% (1200-1300 gms peel force) |
| Sample 2 UVF ink Acrylic Coated BOPP | 0% (800-1200 | 0% (1100-1200 |

-continued

| Ink/Label face stock/Adhesive | Ink Adhesion/ 5 mins | Ink Adhesion/ 60 mins |
|---|---|---|
| Paper Grade Adhesive | gms peel force) | gms peel force) |
| Sample 3 UVF ink | 0% | 0% |
| Acrylic Coated BOPP | (800-1200 | (1300-1400 |
| Paper Grade Adhesive | gms peel force) | gms peel force) |
| Sample 1 water-based ink | 0% | 0% |
| Solvent Primed BOPP | (1300-1500 | (1400-1500 |
| Food Grade Adhesive | gms peel force) | gms peel force) |
| Sample 1 water-based ink | 0% | 0% |
| Acrylic Coated BOPP | (1100-1500 | (1200-1500 |
| Food Grade Adhesive | gms peel force) | gms peel force) |
| Sample 2 UVF ink | 0% | 0% |
| Solvent Primed BOPP | (1000-1400 | (1300-1600 |
| Food Grade Adhesive | gms peel force) | gms peel force) |
| Sample 2 UVF ink | 0% | 0% |
| Acrylic Coated BOPP | (1100-1500 | (1100-1500 |
| Food Grade Adhesive | gms peel force) | gms peel force) |
| Sample 3 UVF ink | 0% | 0% |
| Solvent Primed BOPP | (600-1300 | (1200-1300 |
| Food Grade Adhesive | gms peel force) | gms peel force) |
| Sample 1 water-based ink | 0% | 0% |
| Solvent Primed BOPP | (1000-1400 | (900-1200 |
| Short-term removability adhesive | gms peel force) | gms peel force) |
| Sample 1 water-based ink | 0% | 0% |
| Acrylic Coated BOPP | (900-1200 | (1000-1200 |
| Short-term removability adhesive | gms peel force) | gms peel force) |
| Sample 2 UVF ink | 0% | 0% |
| Solvent Primed BOPP | (600-800 | (750-950 |
| Short-term removability adhesive | gms peel force) | gms peel force) |
| Sample 2 UVF Ink | 0% | 0% |
| Acrylic Coated BOPP | (700-800 | (800-1100 |
| Short-term removability adhesive | gms peel force) | gms peel force) |
| Sample 3 UVF ink | 0% | 0% |
| Acrylic Coated BOPP | (600-900 | (750-900 |
| Short-term removability adhesive | gms peel force) | gms peel force) |

The basic steps of a preferred method of producing the reverse-printed, pressure-sensitive labels is described as follows: A label face stock comprising a clear, 150-250 gauge biaxially oriented polypropylene (BOPP) film top-coated with an acrylic coating or pre-primed with a solvent primer is printed over the acrylic coating or solvent primer on the reverse side of the label face stock using a reverse flexo-graphic printing process. The printing is performed on a separate line and fed into the label making apparatus, or printed in-line with the label making apparatus, using a turning apparatus or other known method to feed the printed web into such apparatus at a first work station. The desirability of this invention is that printing also may be performed using roto-gravure, offset, letterpress, digital, silk screen or other printing methods that would enable the label to achieve 100% adhesion to the label face stock and allowing short-term removability following application of the label to a container surface. Short-term removability is desirable by label applicators and reduces waste in the event that rework is necessitated. A preferred ink is either water-based or UVF Flexo ink, such as those commercially available and produced by ink manufacturers such as Sun Chemical, Siegwerk and/or INX. The label face stock may also include natural or synthetic papers, polymeric films, metal foils and combinations thereof. The label face stock may be printed on the top surface of the label face, the reverse surface of the label face, or both surfaces for application as pressure sensitive labels. The preferred label face stock is a 150-250 gauge clear biaxially oriented polypropylene (BOPP) film or a 92 gauge polyester (PET) film, and the preferred release liner stock is a 48 gauge PET. A preferred adhesive is hot melt, such as those commercially available and produced by manufacturers such as Bostik and Novamelt.

At a second work station, a consistent weight of hot melt adhesive is applied across the web using a rotary application method, rod application method, an adhesive slot die coater or other known means of applying hot melt adhesive. The adhesive is evenly and consistently applied across the web, monitored in real-time using an infrared scanner. A desired adhesive coat weight is between 14 and 20 grams per square meter, or as necessary for the particular customer application. The applicator applies the adhesive over the ink by any known means on the reverse side of the label face stock before entering the third work station, the cutting mechanism used to cut label shapes.

The preferred method of cutting labels uses a chilled die head cutter with multiple cutting edges and an anvil cutter to either clean-cut label shapes, micro-bridge, or micro-perforate the edges of labels as a means of stabilizing the label with or without vacuum. Label shapes are cut through the exposed adhesive on the reverse side of the label face stock. Micro-bridging comprises cutting the label face stock on the exposed adhesive side with two or more small sections of the label not cut through, leaving such micro-sections attached to the matrix surrounding the cut label shapes. Micro-perforated labels comprise a label shape perforated around the edges rather than clean-cut through the face stock. The die cutting tool preferred is a chilled die head with multiple cutting edges that has an inner chamber through which a coolant liquid is circulated. The die head is cooled at or below the glass transition temperature (Tg) of the adhesive used. The preferred method does not require the use of more than one cooled roller, as in other prior art chilled die cutting methods, which require a chilled roller to first cool the adhesive on the face stock before entering the cutting apparatus.

At a fourth work station, the web of cut label shapes on the label face stock is conveyed to a laminator into which a release liner is simultaneously fed. The preferred release liner is a 40-150 gauge (0.4-1.5 mil) polymeric film (e.g., polyester (PET) film) pre-coated with an adequate layer of silicone to permit the requisite release of the label from the liner during the application process; release liner thicknesses of from about 0.4 to 1.2 mil are preferred by this invention, with a 92 gauge thickness also being particularly preferred. Alternative release liners can be pre-siliconized polymeric films, papers (natural or synthetic fibers), or combinations thereof. The label face stock is laminated to the release liner using one or more nip rollers such that the reverse-printed face stock layer is adjacent to the silicone-coated layer of the release liner. Preferred adhesives can be those commercially available and used typically in food grade applications, paper applications, clear to clear film applications or short-term removability applications, such as those hot melt adhesives manufactured by Bostik or Novamelt. Lamination of the label face stock and the release liner forms a continuous, multiple label-width web of reverse printed labels on liner. Lamination occurs immediately after the application of the die cutting operation, eliminating the need for vacuum stabilization; however, vacuum stabilization may be practiced as part of the invention as well. The matrix surrounding the label shapes is then removed using a known vacuum method and rewinding the matrix on a roll.

At a final work station, immediately after removal of the matrix, the multiple-label width web is then slit into multiple single label-width webs using generally known slitting methods. After slitting into the desired widths, the final product is rewound into rolls of single label widths.

While the invention has been described in connection with what is presently considered to be the most practical and preferred embodiment, it is to be understood that the invention is not to be limited to the disclosed embodiments; but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A label assembly comprising a release liner coated with a layer of silicone sufficient to produce adhesion to a label face stock and easy release of the label face stock when applied to a container surface; an adhesive layer that permits easy short-term removability after application to a container surface with 100% ink adhesion to a label surface; and a die-cut label face stock that is printed with ink on at least one surface and laminated to the release liner using the adhesive applied to a back or reverse side of the printed label face stock; wherein the release liner is a 40-150 gauge polymeric film, and wherein there is no overlamination on face stock that is surface-printed.

2. The label assembly of claim 1, further comprising ink printed on the reverse side of the label face stock, or on the reverse and top surface of the label face stock, or on the top surface of the label face stock.

3. The label assembly of claim 1, wherein the adhesive is a hot melt or acrylic adhesive applied to the reverse or back side of the label face stock in a desired coat weight appropriate to an application.

4. The label assembly of claim 3, wherein the adhesive is applied over the ink printed on the reverse side of the label face stock.

5. The label assembly of claim 1, wherein the adhesive permits short-term removability of a label after being applied to the surface of a container with 100% adhesion of ink to the label when the label is removed from the container surface.

6. The label assembly of claim 1, wherein the adhesive permits 100% adhesion of ink to the label surface after use of between 600 and 1800 grams of peel force after 5 and up to 60 minutes after the label is applied to a container surface and removed therefrom.

7. The label assembly of claim 6, wherein the container surface to which the label is applied is plastic or glass.

8. The label assembly of claim 1, wherein the adhesive is applied and continuously monitored in real-time using an infra-red scanner.

9. The label assembly of claim 1, wherein the ink is water-based, solvent based, UVF (ultraviolet flexographic), UV (ultraviolet), or flexographic.

10. The label assembly of claim 1, wherein the ink can be printed using flexo-graphic, roto-gravure, digital, offset, letterpress, or silkscreen techniques.

11. The label assembly of claim 1, wherein the label face stock is of an effective gauge per the application of biaxially oriented polypropylene (BOPP) top-coated with acrylic on the reverse side of the label face stock.

12. The label assembly of claim 1, wherein the label face stock is of an effective gauge per application of BOPP primed with a solvent primer and treated with a Corona treater on the reverse side of the label face stock.

13. The label assembly of claim 1, wherein the label face stock is natural or synthetic fibered paper, cellulose based films, corn-based renewable resource or feedstock film, cellophane, polymeric film, metal foil, PET or combinations thereof.

14. The label assembly of claim 1, wherein the polymeric film is a polyester film.

15. The label assembly of claim 1, wherein the label face stock may be printed or covered with a varnish or glue.

16. The label assembly of claim 14, wherein the polyester film is polyethylene terephthalate.

17. The label assembly of claim 1, wherein the polymeric film is a 92 gauge polymeric film.

18. A label assembly comprising a release liner coated with a layer of silicone sufficient to produce adhesion to a label face stock and easy release of the label face stock when applied to a container surface; an adhesive layer that permits easy short-term removability after application to a container surface with 100% ink adhesion to a label surface; and a die-cut label face stock that is printed with ink on at least one surface and laminated to the release liner using the adhesive applied to a back or reverse side of the printed label face stock; wherein the release liner is a 40-150 gauge polymeric film, and wherein the back or reverse side of a polymeric film label face stock is printed with full coverage graphics and white ink to replicate a white film or a paper label face, and to obviate the need for overlamination on face stock that is surface-printed.

19. The label assembly of claim 18, wherein the polymeric film is a polyester film.

20. The label assembly of claim 18, wherein the polymeric film is a 92 gauge polymeric film.

* * * * *